US005941438A

United States Patent [19]

Price

[11] Patent Number: 5,941,438

[45] Date of Patent: Aug. 24, 1999

[54] UTILITY BELT

[76] Inventor: William Price, 415 N. Burris Ave., Compton, Calif. 90221

[21] Appl. No.: 08/961,009

[22] Filed: Oct. 30, 1997

Related U.S. Application Data

[60] Provisional application No. 60/029,715, Nov. 12, 1996.

[51] Int. Cl.[6] ..... A45C 1/04; A45F 3/00; F41C 33/02; F42B 39/02

[52] U.S. Cl. ..... 224/662; 224/660; 224/665; 224/672

[58] Field of Search ..... 224/195, 587, 224/660, 661, 662, 665, 666, 667, 672, 901.2, 901.4, 901.6, 904, 914

[56] References Cited

U.S. PATENT DOCUMENTS

| | | | |
|---|---|---|---|
| 3,664,560 | 5/1972 | Perkins | 224/914 |
| 4,384,372 | 5/1983 | Rector | 224/914 |
| 4,747,527 | 5/1988 | Trumpower, II | 224/662 |
| 5,464,136 | 11/1995 | Eddy | 224/666 |

*Primary Examiner*—David J. Walczak
*Assistant Examiner*—Timothy L. Maust
*Attorney, Agent, or Firm*—Benman & Collins

[57] ABSTRACT

The belt includes a yieldable flat foam core tapering inwardly from narrow attachment ends outwardly to a wider portion which is positioned adjacent a wearer's back. The foam core serves to provide a measure of back support for the wearer while preventing abrasion of the wearer's hip bones due to the weight of objects suspended from the belt. The narrower portions of the belt which are positioned adjacent the wearer's abdomen provide additional comfort by preventing restriction of movement due to the belt in bending situations. The foam core is covered entirely with a fitted fabric cover for appearance and durability of the foam core. In addition, the fabric cover is trimmed with an abrasion resistant material such as nylon to prevent wear of the fabric cover. The fabric-covered foam core is secured to a strip of webbing material, typically by longitudinal and transverse stitching. The utility belt includes an infinitely adjustable attachment means affixed to the webbing material. The attachment means comprises a rigid ring, preferably rectangular in shape, attached to one end of the webbing strip and a VELCRO hook strip attached adjacent to the other end of the webbing strip. The hook strip extends through the rigid ring and is doubled back to fasten to a VELCRO loop strip attached adjacent to the hook strip. The utility belt may include various strip loops, rings, hooks and pockets designed to accommodate various tools or other items to be suspended from the belt.

1 Claim, 1 Drawing Sheet

UTILITY BELT

RELATED APPLICATION

The following patent application claims priority from provisional application number 60/029,715, filed Nov. 12, 1996.

FIELD OF THE INVENTION

This invention relates to the field of utility belts in general and may be adapted for uses in many fields, such as building maintenance, military, climbing and sports.

BACKGROUND OF THE INVENTION

Various kinds of belts have been devised for centuries—in many instances for military purposes. For many years, belts were constructed of a leather strip with some type of buckling and having attached or attachable thereto, means to hang from the belt a sword, bayonet, knife, canteen and ammunition holder or other items that may be needed by the wearer of the belt. Apart from the military, belts have been specially made for the purpose of carrying tools and other items, such as is shown in U.S. Pat. Nos. 1,600,027, 3,364,560, 4,993,614 and 5,004,136.

While belts were generally made of leather, with the availability today of various fabrics and plastics, belts have been, and are, made of a number of other materials.

One of the problems with most belts, particularly where they are utilized for the purpose of carrying a plurality of heavy articles, is that they tend to come to rest on the wearer's side hip bones, and/or offer little or no support to the wearer's back. Moreover, little attention has been given to the general comfort of the wearer, particularly where, when the belts were made of leather or webbing. Further, while most belts were adjustable, such adjustments were effected on a step-by-step basis, such as through notches or buckles provided on one end of the belt and designed to engage one of several spaced-apart holes in the other end of the belt. This often resulted in a belt that was either too tightly or too loosely fitted about the waist of the wearer.

What has been needed, therefore, is a utility belt from which articles needed by the wearer may be hung, which is particularly comfortable when worn about the wearer's waist and about which it may be precisely fitted; and, in addition, offers particular support across the wearer's back.

SUMMARY OF THE INVENTION

The present invention comprises a belt, the core of which is of a yieldable flat foam material which is covered on both sides by a full width of a fabric, such as felt, and which extends for a length sufficient to encircle the girth of the wearer. Preferably, this fabric on both sides of the foam is trimmed with a strip of nylon to prevent fraying of the fabric which covers the foam core. The width of the belt desirably is such that its ends are narrower tapering rearwardly to a wider width along the portion in contact with the wearer's back. With this configuration, that the part of the belt which may be placed against the wearer's abdomen, will not be uncomfortable. In addition, the fabric covering the foam core may be stitched longitudinally and transversely to secure the foam core in permanent position relative to fabric cover. The outside of the fabric-covered core may then have secured to it a nylon webbing strip. The webbing strip, which extends from one end of the core and beyond for a predetermined distance, to the opposite end, where it may be double-backed about a metal ring, preferably of a rectangular shape, carried by that end. The portion of the nylon webbing strip which extends beyond the extent of the fabric-covered core may be provided with a strip of VELCRO hooks and a strip of VELCRO loops. The strip of VELCRO loops extends from the hooking strip back along the webbing strip to the end of the fabric-covered core and for a predetermined distance.

Depending from, and secured to, the nylon webbing strip may be a plurality of small nylon strip loops, some of which may be provided with metal rings of various sizes to receive tools. Additionally, one or more metal hooks may be attached by rivets at predetermined points along the side or back areas of the main strip of nylon webbing. Additionally, one or more nylon loops and/or a pocket may also be secured to the nylon webbing strip.

The belt of the present invention therefore may be secured about the waist of a person by passing the hooking portion of one end of the webbing through the metal ring on the other end of the webbing and doubling back the hooking portion through the ring to engage the nylon looping strip. Thereby, the belt may easily be fitted exactly about the wearer.

DESCRIPTION OF THE PREFERRED EMBODIMENT

Figure 1:
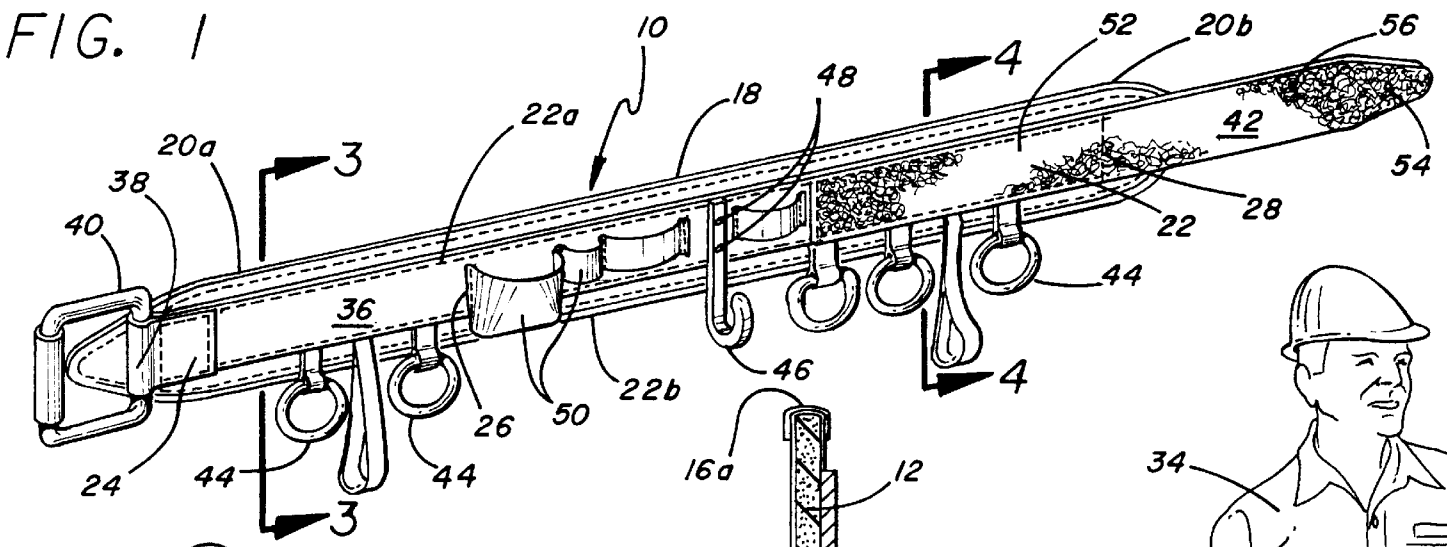
FIG. 1 is perspective view of the belt completely opened up and taken from the outside of the belt.
Figure 2:
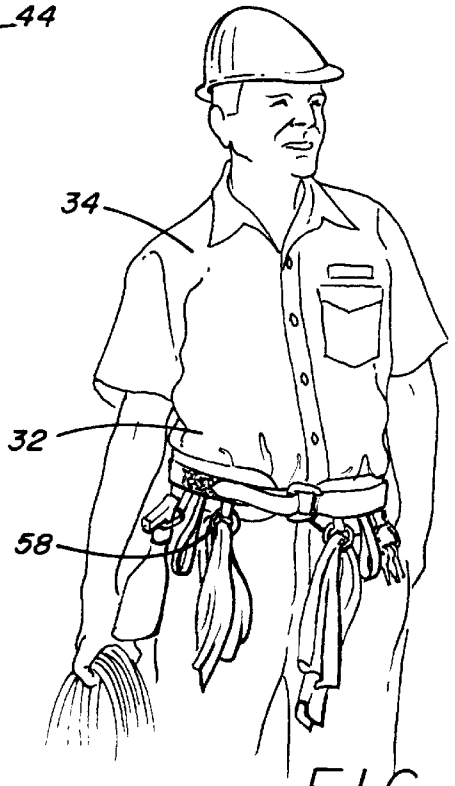
FIG. 2 is an illustration of how the belt may be worn.
Figure 3:
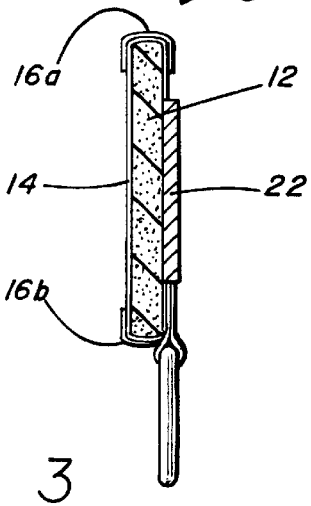
FIG. 3 is a section taken on the line 3—3 of FIG. 1.
Figure 4:
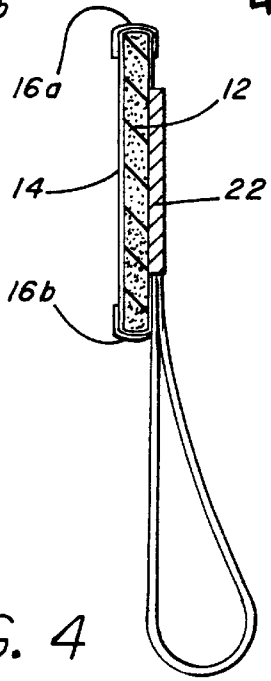
FIG. 4 is a section taken on the line 4—4 of FIG. 1.

Referring to FIGS. 1, 3 and 4 of the drawing, the belt 10 may be constructed of a foam material of between a quarter and a half inch in thickness of sufficient length to encircle the wearer. Desirably, the foam core 12 is covered on both sides with a fabric 14 and trimmed top and bottom with tapes 16*a*, 16*b*, respectively, which may be stitched or otherwise secured along the upper and lower edges of the fabric 14. The belt 10 desirably should be of greater width at the center 18 than at either end 20*a*, 20*b*, with outward tapering from the ends 20*a*, 20*b* to that portion of the central area 18 which is designed to fit across the wearer's back.

There is also provided, to extend along the full length of the foam core 12, and beyond the extremities of the latter, a heavy nylon webbing 22 which may be stitched along its edges 22*a*, and 22*b* through the foam core 12 and its fabric cover 14. In addition, cross-stitching may be provided at selective locations such as 24, 26 and 28.

In order to enable the ends 20*a*, 20*b* of the belt to be secured about the waist 32 of a wearer 34, one end of the webbing 22 may be doubled back upon itself to provide a loop 38 for a buckle 40 with the stitching 24 securing the end 36 to the underlying portion of the webbing 22 and the fabric covered foam core 12. The opposite end 20*b* may have overlaid upon it a web extension 42.

For utilitarian purposes, a plurality of rings 44, and one or more hooks 46, may be secured to the webbing either between it and the fabric-covered foam core 12, as by stitching or, as in the case of the hook, externally by rivets 48 through the webbing 22. In addition, loops 50 may be provided to enable items, such as a hammer, screw driver, etc. to be hung from the belt 10.

In order to enable the end 20*b* of the belt to be adjustably secured through the buckle 40 an area of the webbing 22 may be provided with a VELCRO hook or loop covering 52 with mating VELCRO hooking or looping and provided along an area 56 on the outside of the end 42 of the webbing 22.

In use, the belt is mounted around the waist 32 of a person 34, with the end 42 of the belt 10 slipped through the buckle 40 and doubled back upon itself to where the belt 10 comfortably encircles the wearer's waist 32, at which point the VELCRO end 42 is brought back upon itself for engagement of the VELCRO hooks or loops 54 with the mating hooks or loops of the area 52. Once the belt is thus secured, tools or other items 58 may be hung from the loops 44 hook 46 or inserted through the loops 56. Because of the Velcro engagements 52, 54 it will be appreciated that the length of the belt 10 may readily be adjusted to provide comfort to the wearer 34. In addition, because the middle area 18 of the belt is wider than the belts' ends 20*a*, and 20*b*, along the wearer's back (not shown), the belt 10 may actually provide back support for the wearer 34.

From the foregoing description with reference to the drawing, it should be appreciated that the belt of the present invention is most utilitarian and offers numerous advantages over prior art belts.

I claim:

1. An improved utility belt, comprising:

a yieldable flat foam core, said core extending for a length sufficient to encircle a girth of a wearer, said core extending for a length sufficient to encircle a girth of a wearer, said core being narrowest at its first and second end and widening outwardly to a maximum width along that portion which would be in contact with a wearer's back;

said core having a first end and a second end;

a fabric cover surrounding said core to present an external surface, said cover being trimmed with abrasion resistant material such as nylon, to prevent fraying of the cover;

said fabric cover being stitched through the core to secure the core in permanent position relative to the cover;

a webbing strip, having a first end and a second end, and being affixed on the external surface of said fabric cover;

said webbing strip extending from the first end of the core, and beyond for a first predetermined distance, to the second end of the core, and beyond for a second predetermined distance;

a rectangular rigid ring secured to the first end of the webbing strip and sized to accommodate the second end of the webbing strip;

an adjustable attachment means secured adjacent to the second end of the webbing strip for removable engagement with said anchoring device comprising a strip of VELCRO hooks affixed to a portion of the webbing strip extending beyond the second end of the fabric-covered core, and a strip of VELCRO loops extending from the strip of VELCRO hooks back along the webbing strip to the second end of the fabric-covered core and for a third predetermined distance;

at least one rigid hook securely attached to a predetermined point along the webbing strip, said hook being attached along a central portion of the belt;

a plurality of small strip loops depending from and secured to the webbing strip;

one or more rigid rings suspended from said strip loops on both sides of said hook and sized to accommodate items to be suspended from the webbing strip; and at least one pocket secured to the webbing strip on at least one side of said hook.

* * * * *